United States Patent [19]

Pringle et al.

[11] Patent Number: 4,538,685

[45] Date of Patent: Sep. 3, 1985

[54] LOCKING ANNULUS SAFETY VALVE

[75] Inventors: Ronald E. Pringle, Houston; Paul W. Black, Sugarland, both of Tex.

[73] Assignee: Camco, Incorporated, Houston, Tex.

[21] Appl. No.: 540,080

[22] Filed: Oct. 7, 1983

[51] Int. Cl.[3] ..... E21B 34/10

[52] U.S. Cl. ..... 166/321; 166/322; 166/382; 166/386

[58] Field of Search ..... 166/133, 120, 131, 212, 166/203, 321, 322, 382, 386, 115, 129, 183; 277/124, 73

[56] References Cited

U.S. PATENT DOCUMENTS

| | | | |
|---|---|---|---|
| 1,324,775 | 12/1919 | Anathor-Henriksen | 277/73 X |
| 3,131,769 | 5/1964 | Rochemont | 166/212 |
| 3,288,221 | 11/1966 | Howard | 166/72 X |
| 3,410,348 | 11/1968 | Page | 166/120 |
| 4,049,052 | 9/1977 | Arendt | 166/183 |
| 4,224,987 | 7/1980 | Allen | 166/120 |
| 4,252,197 | 2/1981 | Pringle | 166/322 |
| 4,273,194 | 6/1981 | Pringle et al. | 166/323 |
| 4,363,358 | 12/1982 | Ellis | 166/212 |

*Primary Examiner*—Stephen J. Novosad
*Assistant Examiner*—Michael Goodwin
*Attorney, Agent, or Firm*—Fulbright & Jaworski

[57] ABSTRACT

An annulus subsurface safety valve for installation between inner and outer concentric members and controlling a fluid passageway therein in which the safety valve is locked to the outer member when the fluid passageway is closed. The outer member is provided with a threaded section and the safety valve housing includes a plurality of segments carried for inward and outward movement in which the segments include threads on the outside for coacting with the threaded section. A lock is provided upon the valve closure of the safety valve and positioned to be out of engagement with the segments when the valve is in the open position but is in engagement with and locks the segments outwardly in engagement with the threaded section when the valve is in the closed position. Springs urge the segments outwardly whereby the valve may be ratcheted downwardly into the threaded section and can be released from the threaded section by opening the passageway or can be released by rotation. A metal packing seal around the housing seals against the outer member and is provided with a piston for compressing the packing when exposed to pressure between the members.

12 Claims, 8 Drawing Figures

12
20
50
4
4
10
18
14
16
46
32
28
54
52
30
26

12
50
10
18
46
16
32
30
26

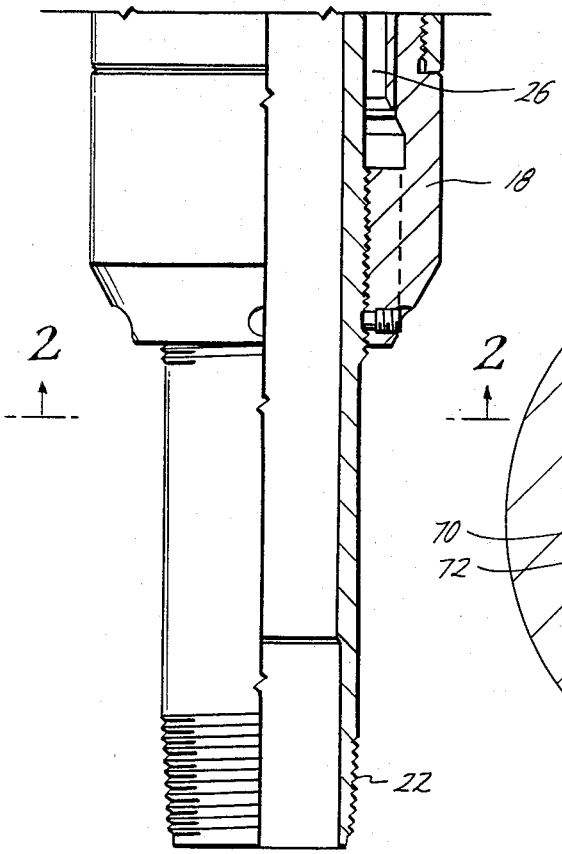
Fig. 1C
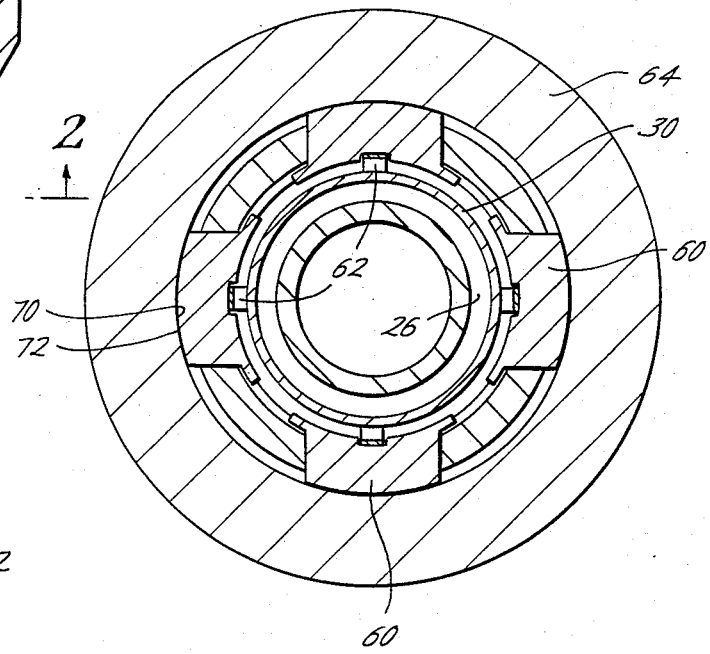
Fig. 3
Fig. 2
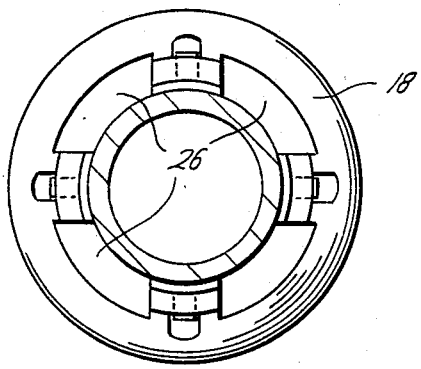
Fig. 4
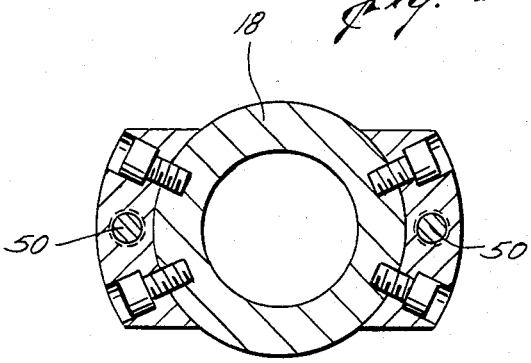

LOCKING ANNULUS SAFETY VALVE

BACKGROUND OF THE INVENTION

The use of a subsurface annulus safety valve for installation between inner and outer concentric tubular members such as a well tubing and a well casing and for opening and closing the annulus is well known as shown in U.S. Pat. Nos. 4,049,052 and 4,273,194. However, while prior annulus safety valves were secured to or connected to the inner tubular member or tubing, they were merely sealed against the outer tubular member or casing by an integral seal or by a well packer. That is, the annulus safety valve was not locked to the outer tubular member such as the casing. However, it is important to have the annulus safety valves releasably locked to the outer member for insuring the control of the well. In the event of a failure, such as the loss of a wellhead, high pressures below the packer would allow the tubing, and all safety valves connected thereto to be blown out of the well.

SUMMARY

The present invention is directed to an annulus subsurface safety valve adapted for installation between inner and outer concentric tubular members in which the safety valves may be releasably locked to the outer member.

A still further object of the present invention is wherein the safety valve, which includes a fluid passageway which is opened and closed by the valve, is locked to the outer member when the valve is moved to the closed position.

Yet a still further object of the present invention is the provision of an annulus subsurface safety valve which can be installed into an outer member with a downward movement, can be locked thereto when needed, and can be released by opening the safety valve, or in the event of failure in the safety valve can be released by rotation.

Yet a further object of the present invention is the provision of an annulus subsurface safety valve adapted for installation between inner and outer concentric tubular members having a housing for connection to the inner member with a fluid passage therethrough. A valve closure means is provided for opening and closing the passageway and means are provided for controlling the movement of the valve closure means. The valve is provided with means for locking the housing to the outer member when the fluid passageway is closed. Engaging means are carried by the housing for inward and outward movement and locking means are provided on the valve closure means and positioned to be out of engagement with the engaging means when the valve closure means is opened. The locking means is moved into engagement with and locks the engaging means outwardly in engagement with the outer member when the valve closure means is closed.

Another object of the present invention is wedge-shaped coacting surfaces between the locking means and the engaging means for wedging the engaging means outwardly into engagement with the outer member.

Yet a still further object is the provision of threads on the outside of the engaging means for coacting with the threads on the outer member whereby the safety valve may be locked to the outer means but released by rotation.

Yet a further object is the provision of spring means yieldably urging the engaging means outwardly whereby the valve may be ratcheted downwardly into the outer member. Preferably, shoulder means are provided on the housing for engaging a coacting shoulder on the outer member for positioning the valve relative to the outer member.

Still a further object of the present invention is the provision of metal packing around the outside of the housing for sealing against the outer member. Piston means are provided below but against the packing and sealing against the housing and adapted to seal against the outer member for compressing the packing when exposed to pressure between the members.

Still a further object of the present invention is the provision of an annulus subsurface safety valve adapted for installation between inner and outer concentric tubular members having a housing for connection to the inner member and having a fluid passageway therethrough. Valve closure means are provided for opening and closing the passageway and hydraulic control means extend to the surface for actuating the valve closure means to the open position. Biasing means in the housing bias the valve closure means to the closed position when the hydraulic control means is deactuated. Locking means for locking the safety valve to the outer member when the valve closure means is moved to the closed position includes an outer member having a threaded section. A plurality of engaging segments are carried by the valve housing for inward and outward movement and the segments include threads on the outside for coacting with the threaded section. Locking means, including wedge surfaces on the valve closure means, are positioned to be out of engagement with the segments when the valve closure means is in the open position, but is in engagement with and locks the segments outwardly in engagement with the threaded section when the valve closure means is in the closed position.

Other and further objects, features and advantages will be apparent from the following description of a presently preferred embodiment of the invention, given for the purpose of disclosure, and taken in conjunction with the accompanying drawings where like character references designate like parts throughout the several views.

BRIEF DESCRIPTION OF THE DRAWINGS

FIGS. 1A, 1B and 1C are continuations of each other and are fragmentary elevational views, partly in cross section, illustrating the annulus safety valve of the present invention in its open and unlocked position, FIG. 2 is a cross-sectional view taken along the line 2—2 of FIG. 1C, FIG. 3 is a cross-sectional view taken along the line 3—3 of FIG. 1B, FIG. 4 is a cross-sectional view taken along the line 4—4 of FIG. 1A, and FIGS. 5A and 5B are continuations of each other and are fragmentary, quarter elevational views in cross section of the annulus valve of the present invention in the closed and locked position.

DESCRIPTION OF THE PREFERRED EMBODIMENT

Figure 1A:
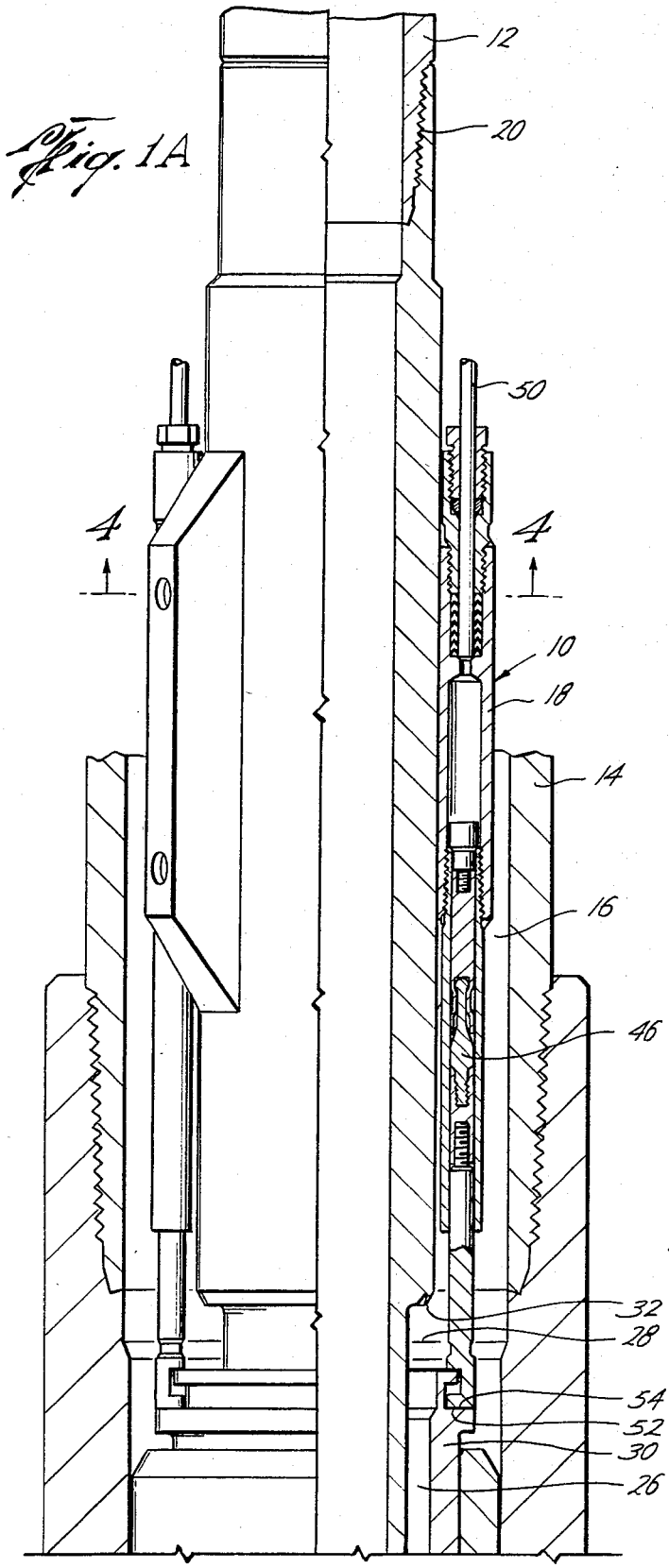
Figure 1B:
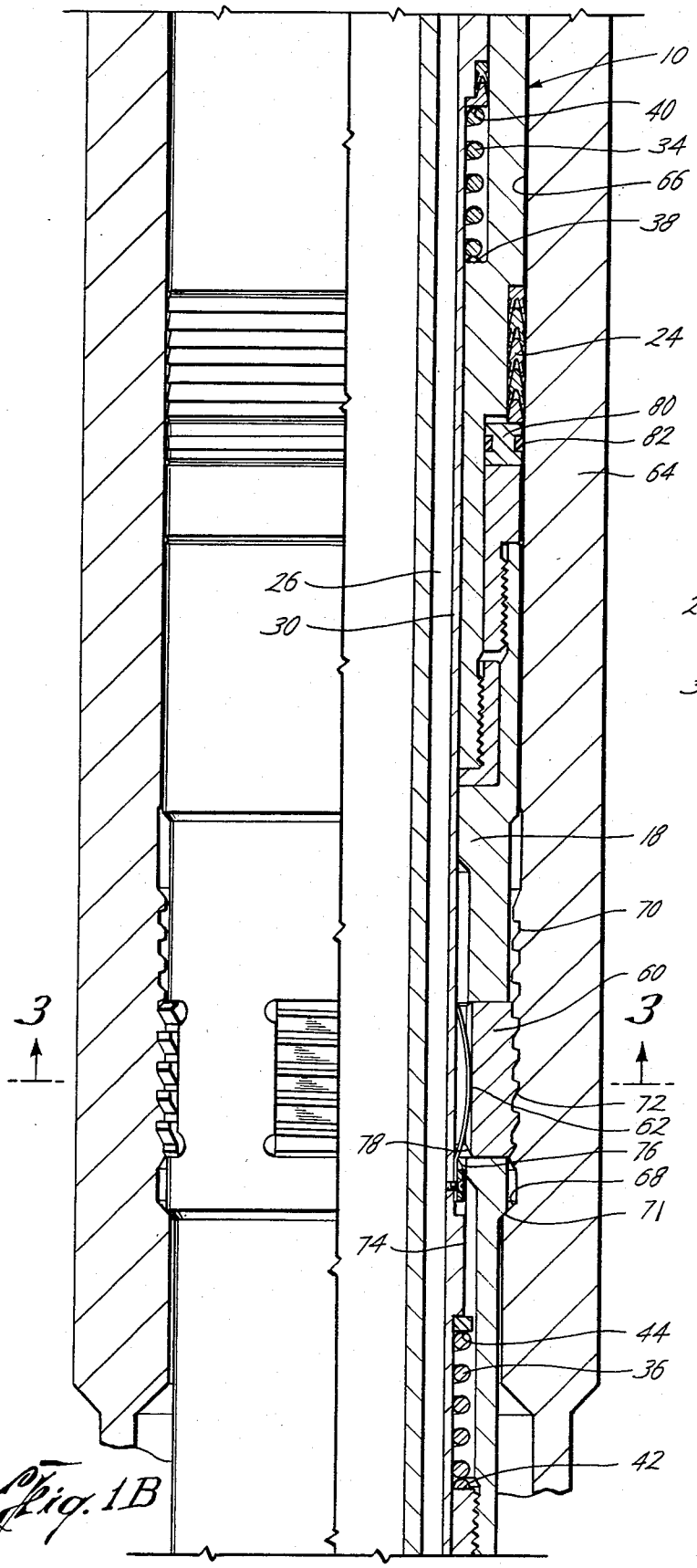

Referring now to the drawings, and particularly to FIGS. 1A, 1B and 1C, the annulus subsurface safety valve of the present invention is generally indicated by the reference numeral 10 and is adapted for installation between an inner 12 and an outer 14 concentric tubular member such as a well tubing 12 and well casing 14. An annulus 16 is formed between the tubular members 12 and 14. The safety valve 10 includes a housing 18 which may include threaded connections 20 and 22, at the top and bottom respectively, for connection in the well tubing 12. The annulus safety valve 10 includes a packing 24 for packing off between the inner tubular member 12 and the outer tubular member 14 and includes a passageway 26 therethrough which is opened and closed by the valve 10 for controlling fluid flow through the annulus 16.

Figure 5A:
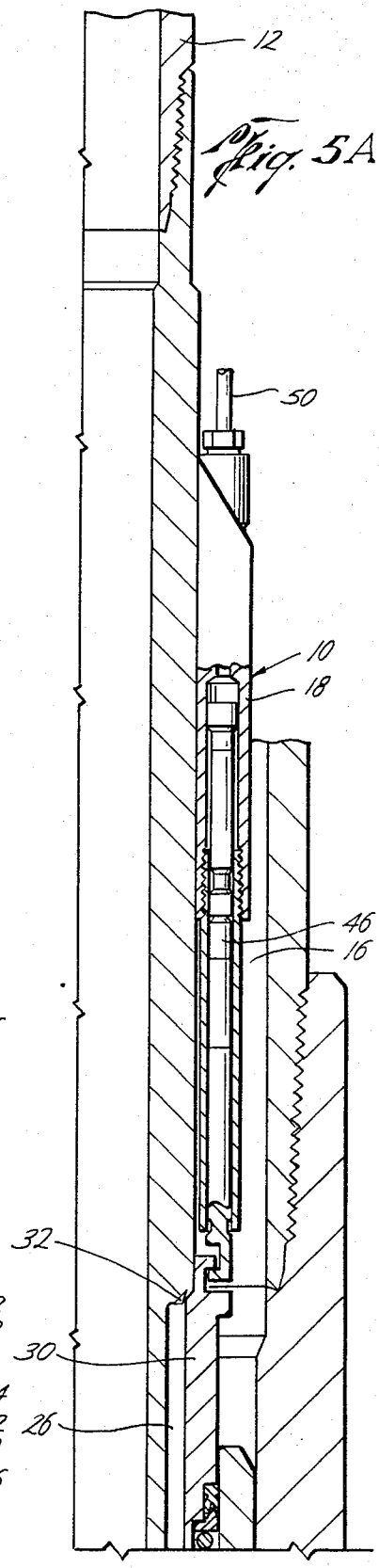

The passageway 26 leads from the bottom of the safety valve 10 up to an annular opening 28 to the exterior of the housing 18 for communicating the passageway 26 with the annulus 16 between the members 12 and 14. A tubular valve closure member 30 is telescopically movable in the interior of the housing 18 for opening and closing the annular opening 28. When the closure member 30 is in the down position, as best seen in FIG. 1A, the valve opening 28 is opened, and when the valve closure member 30 moves upwardly and seats on a valve seat 32, as best seen in FIG. 5A, the opening 28 is closed. Thus, control of the valve closure member 30 controls flow through the annulus 16.

In order to control the movement of the valve closure member 30, various forces may be provided. Thus, biasing means, such as springs 34 and 36 (FIG. 1B) act between the housing 12 and the valve closure member 30 for yieldably urging the valve closure member 30 in an upward direction to close the valve opening 28. Thus spring 34 acts between a shoulder 38 on the housing 12 and a shoulder 40 on the valve closure member 30. Similarly, spring 36 acts between a shoulder 42 on the housing 12 and a shoulder 44 on the valve closure member 30. In order to move the valve closure member 30 downwardly, and open the opening 28, one or more pistons 46 (FIG. 1A) preferably two, are provided which are telescopically movable in the housing 12 such as more fully described in U.S. patent application Ser. No. 06/383,897, filed June 1, 1982, and which are controlled by hydraulic fluid in a hydraulic line 50 which is adapted to extend to the well surface for actuating the closure member 30 in a direction to open the valve opening 28. The pistons 46 are connected to the valve closure member 30 by coacting shoulders 52 and 54. Release of the hydraulic pressure in the line 50 allows the springs 34 and 36 to move the valve closure member 30 upwardly to seat on the valve seat 32 and close the passageway 26.

Therefore, the safety valve 10 is controlled by the application or removal of a pressurized fluid through the control line 50 for controlling fluid flow through the annulus 16.

While the safety valve 10 is supported from the inner tubular member 12 in the well, it may be subjected to high pressures in the well and in the event of unexpected problems such as destruction of the wellhead, high pressures below the packer 24 could blow the well tubing 12 and safety valve 10 out of the casing 14. Therefore, the present invention provides means for locking the well safety valve 10 to the outer tubular member 14 when the safety valve 10 is in the closed position blocking fluid flow through the passageway 26 and annulus 16, at which time the full pressure in the well would be applied to the bottom of the safety valve 10 which seals off between the tubular members 12 and 14.

Referring now to FIG. 1B, a plurality of engaging segments 60 are provided carried by the housing 18 of the valve 10 for inward and outward movement. The segments 60 are movable outwardly for engaging the interior of the outer member 14 and are movable inwardly for releasing from the outer member 14. Preferably, the segments 60 are biased outwardly by suitable spring means 62.

Preferably, the outer member 14 is provided with a landing sub 64 which includes a polished section 66 for receiving the packing seal 24, includes a no-go shoulder 68 for receiving the shoulder 71 on the housing 18 for positioning the safety valve 10 at the desired location in the outer member 14. In addition, the landing nipple 64 includes a threaded section 70 having a plurality of threads, preferably left-handed threads for coacting with threads 72 which are positioned on the outside of the segments 60.

Figure 5B:
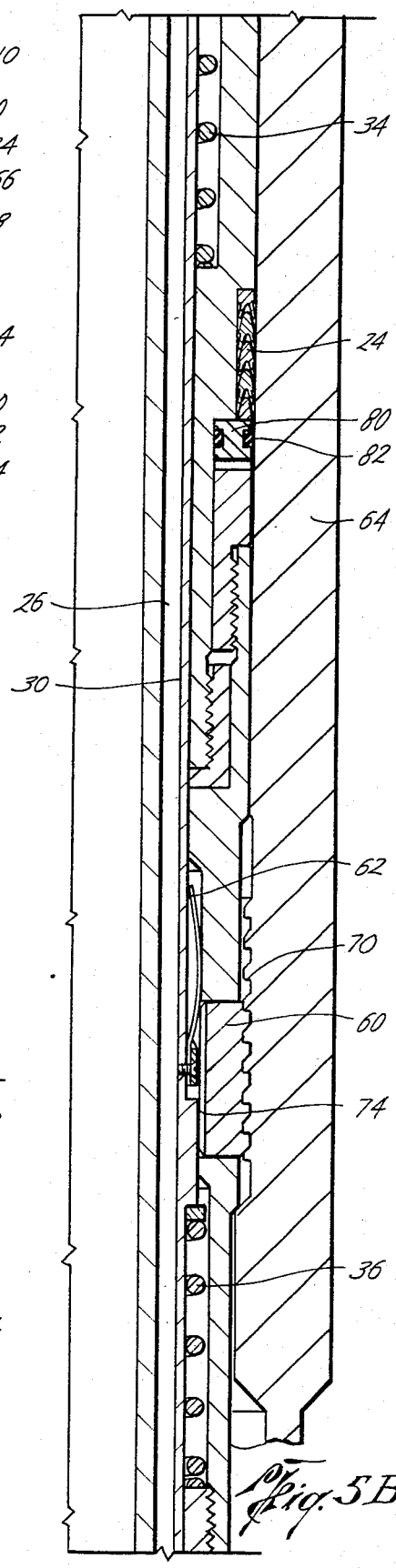

Locking means 74 such as a shoulder is provided on the valve closure member 30 and is positioned, as best seen in FIGS. 1A, 1B and 1C to be out of engagement with the segments 60 when the valve 10 is in the open position. However, as best seen in FIGS. 5A and 5B, when the valve is closed, the valve closure member 30 is moved upwardly moving the locking shoulder 74 behind the engaging segments 60 and locking them in engagement with the landing nipple 64.

Preferably, wedge-shaped coacting surfaces such as surface 76 on the locking means 74 and surface 78 on the back of the segments 60 are provided for allowing the locking means 74 to wedge the engaging segments 60 outwardly into engagement with the landing nipple 64. The safety valve 10 is installed by lowering the inner tubular member 12 with the valve 10 attached thereto into the outer tubular member 14 with hydraulic fluid applied to the line 50 whereby the valve closure member 30 will be in the downward position and the passageway 26 opened as the valve 10 moves downwardly in the annulus 16. The engaging segments 60, while biased outwardly by the springs 62, will ratchet inwardly as they encounter any obstructions in the outer member 14 as well as when they encounter the threaded section 70 in the landing nipple 64. Therefore, the safety valve 10 may be easily installed in the landing nipple 64 by a downward movement. When the shoulder 70 on the valve 10 encounters the shoulder 68 in the landing nipple 64 the valve 10 is correctly positioned in the outer member 14 with the engaging segments 60 aligned with the threaded section 70 in the landing nipple 64. It is also to be noted that with hydraulic fluid applied to the pistons 46 causing the valve closure 30 to move downwardly, the locking shoulder 74 remains out of engagement with the engaging segments 60 and the valve 10 may be removed from the outer tubular member 14 by upward movement as the segments will ratchet past the threaded section 70 and overcome the loading of the spring 62.

The safety valve 10 is closed by reducing the hydraulic pressure in the line 50 thereby reducing the force on the piston 46 which act to move the valve closure member 30 downwardly. In this event, the springs 34 and 36 act against the valve closure member 30 to move it upwardly to close the opening 28 and close the passageway 26. Thus with the flow through the passageway 26 and annulus 16 closed, all of the differential pressure in the annulus 16 will be applied against the safety valve 10. However, with the valve 10 closed, the locking shoulder 74 is in position behind the engaging segments 60 securely locking the threads 72 on the segments 60 with the threaded section 70 of the landing nipple 64. Normally, the valve 10 can be released from the landing nipple 64 at any time by increasing the hydraulic fluid pressure in the line 50, opening the valve, removing the locking shoulder 74 from behind the segments 60, and raising the inner tubular member 12. However, in the event that the line 50 becomes broken or the mechanism of the valve 10 becomes inoperative, the valve 10 can still be released from the landing nipple 64 by rotation, preferably a right-hand rotation, as the threaded segment 60 will disengage from the threaded section 70 of the landing nipple 64 by rotation.

Therefore, the annulus safety valve 10 of the present invention is particularly adapted for conditions in which high pressure is encountered in the well.

Another feature of the present invention is the provision of an improved seal 24 for sealing off between the housing 18 and the outer member 14. In order to withstand high pressures, the packing 24 is preferably metal and a piston 80 is provided carried by the housing 18 at a position below and against the packing 24. The piston 80 sealingly engages both the housing 18 and the landing nipple 64 such as by seals 82. The lower end of the piston 80 is exposed to pressure in the annulus 16 below the packer 10. Thus, upon an increase of pressure in the annulus 16 and against the piston 80, the piston compresses the seal 24 to increase the sealing relationship and prevent any leaks in the annulus 16 around the safety valve 10. Of course, the seal 24 and piston 80 may be used in any type of safety valve and its use is not limited to an annulus type safety valve. The piston 80 is unaffected by the normal operation of the safety valve 10 and acts to increase the sealing with the landing nipple 64 in proportion to the amount of pressure encountered in the annulus 16.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In an annulus subsurface safety valve adapted for installation between inner and outer concentric tubular members having a housing for connection to the inner member with a fluid passageway therethrough, valve closure means connected to the housing for opening and closing said passageway, means for controlling movement of the valve closure means including hydraulic actuating means adapted to extend to the surface between the tubular members, the combination of means for locking the housing to the outer member when the fluid passageway is closed comprising, engaging means carried by the housing for inward and outward movement, locking means on the valve closure means, said locking means positioned to be out of engagement with the engaging means when the valve closure means is open but is in engagement with and locks the engaging means outwardly in engagement with the outer member when the valve closure means is closed.

2. The apparatus of claim 1 including, wedge shaped coacting surfaces between the locking means and engaging means for wedging the engaging means outwardly into engagement with the outer member.

3. The apparatus of claim 1 including, threads on the outside of the engaging means for coacting with threads on the outer member whereby the safety valve may be locked to the outer member but released by rotation.

4. The apparatus of claim 3 including, spring means yieldably urging the engaging means outwardly whereby said valve may be ratcheted downwardly into the outer member.

5. The apparatus of claim 4 including, shoulder means on the housing for engaging a coacting shoulder on the outer member for positioning the valve relative to the outer member.

6. The apparatus of claim 1 including, metal packing around the outside of the housing for sealing against the outer member, piston means below but adjacent the packing and sealing against the housing and adapted to seal against the outer member for compressing the packing when exposed to pressure between the members.

7. In an annulus subsurface safety valve adapted for installation between inner and outer tubular members having a housing for connection to the inner member and having a fluid passageway therethrough, valve closure means connected to the housing for opening and closing said passageway, hydraulic control means extending to the surface between the inner and outer members for actuating the valve closure means to the open position, biasing means in the housing for biasing the valve closure means to the closed position when the hydraulic control means is deactuated, the combination of means for locking the safety valve to the outer member when the valve closure means is moved to the closed position comprising, said outer member including a threaded section, a plurality of engaging segments carried by the valve housing for inward and outward movement, said segments including threads on the outside for coacting with the threaded section, and locking means on the valve closure means positioned to be out of engagement with the segments when the valve closure means is in the open position, but is in engagement with and locks the segments outwardly in engagement with the threaded section when the valve closure means is in the closed position.

8. The apparatus of claim 7 including, wedge shaped coacting surfaces between the locking means and the engaging segments for wedging the engaging segments outwardly into engagement with the threaded section.

9. The apparatus of claim 8 including, spring means yieldably urging the engaging segments outwardly whereby said valve may be ratcheted downwardly into the threaded section.

10. The apparatus of claim 8 including, metal packing around the outside of the housing for sealing against the outer member, and piston means below but adjacent the packing and sealing against the housing and against the outer member for compressing the packing when exposed to pressure between the members.

11. In a subsurface valve adapted to be installed in a tubular member having a housing and a fluid passageway therethrough, valve closure means connected to the housing for opening and closing said passageway, hydraulic actuating means connected to the valve closure means for moving said valve closure means to the open position and adapted to extend to the surface between the tubular member and the housing, biasing means connected to the hydraulic actuating means for moving the valve to the closed position, the improvement of sealing means for sealing the housing against the tubular member comprising, metal packing around the outside of the housing for sealing between the housing and the tubular member, and piston means carried by the housing below but adjacent and against the packing and out of communication with the interior of the housing for compressing the packing and increasing the seal when the piston is exposed to pressure between the tubular member and the housing below the packer.

12. The apparatus of claim 11 wherein the piston includes sealing means for sealing between the housing and the tubular member.

* * * * *